US009303419B2

(12) United States Patent
Abels et al.

(10) Patent No.: US 9,303,419 B2
(45) Date of Patent: Apr. 5, 2016

(54) CONCRETE MOLD FOR SPRINKLER INSTALLATION AND INSTALLATION METHOD

(71) Applicant: Tyco Fire Products LP, Lansdale, PA (US)

(72) Inventors: Bernhard Abels, Warwick, RI (US); Michael Imhof, Dresden-Weissig (DE)

(73) Assignees: Tyco Fire Products LP, Lansdale, PA (US); Tyco Building Services Products (Germany) GmbH, Rodgau (DE)

( * ) Notice: Subject to any disclaimer, the term of this patent is extended or adjusted under 35 U.S.C. 154(b) by 0 days.

(21) Appl. No.: 13/855,921

(22) Filed: Apr. 3, 2013

(65) Prior Publication Data

US 2014/0091197 A1 Apr. 3, 2014

Related U.S. Application Data

(60) Provisional application No. 61/706,972, filed on Sep. 28, 2012, provisional application No. 61/779,867, filed on Mar. 13, 2013.

(51) Int. Cl.

| | |
|---|---|
| ***E04G 15/04*** | (2006.01) |
| ***E04G 15/06*** | (2006.01) |
| ***B28B 7/16*** | (2006.01) |
| *A62C 35/58* | (2006.01) |

(52) U.S. Cl.

CPC ..... *E04G 15/063* (2013.01); *B28B 7/164* (2013.01); *E04G 15/068* (2013.01); *A62C 35/58* (2013.01)

(58) Field of Classification Search

CPC ..... E04G 15/063; E04G 15/068; B28B 7/164; B28B 7/18; A62C 35/58; A62C 35/60

USPC ..... 264/31, 35; 249/35

See application file for complete search history.

(56) References Cited

U.S. PATENT DOCUMENTS

| | | | | |
|---|---|---|---|---|
| 1,746,696 A * | 2/1930 | Dows | 249/177 |
| 1,776,195 A * | 9/1930 | Robinson | 52/220.1 |
| 1,908,796 A * | 5/1933 | Suchan | 249/177 |
| 2,286,564 A * | 6/1942 | Newell | 249/177 |

(Continued)

FOREIGN PATENT DOCUMENTS

| | | |
|---|---|---|
| DE | 10 2008 008570 | 8/2009 |
| DE | 20 2009 004938 | 10/2009 |
| DE | 10 2010 012209 | 9/2011 |
| EP | 2 312 088 A2 | 4/2011 |

OTHER PUBLICATIONS

International Search Report and Written Opinion of the International Searching Authority for PCT/US2013/062167, Feb. 5, 2014, 13 pages.

(Continued)

*Primary Examiner* — Michael Safavi
(74) *Attorney, Agent, or Firm* — Perkins Coie LLP

(57) ABSTRACT

A two-component mold assembly for molding an opening within a concrete wall that provides access to a piping system supporting a sprinkler. The first component is an insert that is mounted on a concrete form, and the second component is a cover that slidably fits over the insert to define the opening in the concrete. The cover plugs the piping system during fabrication of the concrete wall and is removable from the opening in the hardened concrete after the concrete form and the mounted insert are removed.

23 Claims, 5 Drawing Sheets

(56) References Cited

U.S. PATENT DOCUMENTS

| | | | | | |
|---|---|---|---|---|---|
| 2,694,847 | A | * | 11/1954 | Christiansen | 249/61 |
| 2,775,017 | A | * | 12/1956 | McDonough | 249/83 |
| 3,004,320 | A | * | 10/1961 | Beckman | 249/177 |
| 3,680,826 | A | * | 8/1972 | Bassani | 249/91 |
| 3,821,338 | A | * | 6/1974 | Faust | 64/35 |
| 4,071,265 | A | * | 1/1978 | Wallace | 285/136.1 |
| 4,077,599 | A | * | 3/1978 | Oland | 249/177 |
| 4,159,099 | A | * | 6/1979 | Maguire | 249/93 |
| 4,261,598 | A | * | 4/1981 | Cornwall | 285/56 |
| 4,642,956 | A | * | 2/1987 | Harbeke | 52/232 |
| 4,804,160 | A | * | 2/1989 | Harbeke | 249/207 |
| 4,823,527 | A | * | 4/1989 | Harbeke | 52/220.8 |
| 4,842,240 | A | * | 6/1989 | Pickett | 249/18 |
| 4,915,055 | A | * | 4/1990 | Ptashinski | 116/209 |
| 5,634,311 | A | * | 6/1997 | Carlton | 52/577 |
| 8,596,605 | B2 | * | 12/2013 | Xie et al. | 249/39 |
| 2007/0006690 | A1 | | 1/2007 | Foster | |
| 2010/0319196 | A1 | | 12/2010 | Rosenberg | |

OTHER PUBLICATIONS

Tyco Fire Products LP, Model FSC 80 K-Factor Flush Sprinkler Concrete Quick Response Standard Coverage Datasheet, TFP645, Oct. 31, 2012, 6 pp. also found at URL: http://tfppemea.com/en/emea/siteassets/lists/productmodel1/editform/ttp645_10_2012.pdf.

U.S. Appl. No. 61/706,972, filed Sep. 28, 2012.

U.S. Appl. No. 61/779,867, filed Mar. 13, 2013.

Minimax GmbH & Co., Sprinkler Systems Undercover Sprinkler Pipe System Product Brochure, Oct. 2009, 4 pages.

Minimax GmbH & Co., Product Catalogue for "Seal Cap for Concrete Shuttering Undercover Sprinkler", 2007, 1 page.

Verified English translation of DE 10 2010 012209,Sep. 22, 2011, Rehau AG & Co., 29 pages.

Verified English translation of DE 10 2009 004938,Oct. 1, 2009, Aquatherm, 23 pages.

* cited by examiner

CONCRETE MOLD FOR SPRINKLER INSTALLATION AND INSTALLATION METHOD

PRIORITY CLAIM & INCORPORATION BY REFERENCE

This application claims the benefit of priority to U.S. Provisional Patent Application No. 61/706,972, filed Sep. 28, 2012, and U.S. Provisional Patent Application No. 61/779,867, filed Mar. 13, 2013, both of which are incorporated by reference in their entirety.

TECHNICAL FIELD

This invention relates generally to fire protection systems and the installation of fire protection systems. More specifically, the invention is directed to the installation of piping and fittings for fire protection systems positioned within concrete walls.

BACKGROUND OF THE INVENTION

Many fire protection systems are configured to deliver a fire fighting fluid from a fluid source to a series of sprinklers distributed throughout a protected area in a defined pattern. In a building or other fixed structure, the fluid can be delivered to wall or ceiling mounted sprinklers through a network of pipes hidden within the walls or ceilings. The hidden piping is commonly run through hollow spaces within walls or ceilings. However, when the walls or ceilings are fabricated from a material that does not provide a hollow structure, such as concrete, it can be difficult to run the pipes after the walls or ceilings are fabricated. Accordingly, a common technique is to run the piping while a concrete wall or ceiling is being fabricated.

When using concrete to fabricate a wall or ceiling containing a sprinkler pipe, it is desirable to have the sprinkler-mountable ends of the piping placed at the correct locations within the concrete wall or ceiling, and to have the ends of the piping accessible after the forms used to shape the concrete wall or ceiling are removed. In some existing systems, sprinkler piping molds are used to connect the ends of the sprinkler pipes to the concrete forms (e.g., plywood boards) while the concrete sets. Before the concrete is introduced to the space defined by the concrete forms, the sprinkler piping molds are mounted on the concrete forms at desired locations, and the sprinkler piping is routed and connected to the sprinkler piping mold. The sprinkler system is then pressure tested to ensure that all piping connections are satisfactory sealed and the wet concrete is introduced to fill the space defined by the concrete form and cover the sprinkler piping and the sprinkler piping molds. The sprinkler piping molds displace a volume of the wet concrete and are removed with the removal of the concrete forms to provide access to the sprinkler piping through the volume defined within the hardened concrete by the sprinkler piping molds.

One such mold is described in European Publication No. 2312088 at FIG. 1, which is incorporated by reference in its entirety. Shown in FIG. 1 is a one-piece mold that has a bell-shaped member that defines a volume for displacing concrete. The bell-shaped member has one end that connects to a pipe and another end that sits against a concrete form. Three fastening members pass through the bell-shaped member to secure the bell-shaped member, and its connected pipe, to the concrete form. As the mold in FIG. 1 is a one-piece mold, the fastening members must be pulled or cut to separate the bell-shaped member from the concrete form, and to gain access to the bell-shaped member so that it can be removed from the pipe. It is believed that the mold described in FIG. 1 of EP2312088 is not an efficient design because of the labor and time required to pull or cut the fastening members to separate the concrete form from the mold, and because the fastening members may not provide a secure connection to the concrete form because the fastening members must remain removable to allow for later separation when the concrete form is removed.

Another concrete mold is described in EP2312088 at FIG. 2. Shown in FIG. 2 is a two-piece concrete mold that has a bell-shaped member with a top piece and a bottom piece. The top piece provides a volume for displacing concrete and the bottom piece fits within the top piece to secure the top piece to the concrete form. The top piece of the bell-shaped member has one end that connects to a pipe and another end that sits against the concrete form while covering the bottom piece. Three fastening members pass through the bottom piece to secure a plate of the bottom piece flatly against the concrete form. The top piece of the bell-shaped member, and its connected pipe, are disposed over a cylindrical wall extending from the bottom piece. As the mold in FIG. 2 is a two-piece mold, the bottom piece is removable when the concrete form is removed, which allows access to remove the top piece of the bell-shaped member from the pipe. It is believed that the mold described in FIG. 2 of EP2312088 is not sufficiently sturdy for use or repeated use at a construction site because the walls of the bottom piece are likely to be deformed or damaged (e.g., when impacted or stepped on), which can provide an inadequate connection to the top piece or prohibit subsequent reuse of the bottom piece. It is also believed that the FIG. 2 design is not efficient because of the additional time and labor that may be required to properly orientate the bottom piece on the concrete form.

FIGS. 3-4 of EP2312088 show a two-piece mold that is represented to be an improvement over the designs of FIGS. 1 and 2, and show a specialized tool that is used to release the mold from the concrete form. As shown in FIGS. 3-4, the two-piece mold has a bell-shaped member that defines a volume for displacing concrete and a plug that holds the bell-shaped member to a pipe. The bell-shaped member has an end that connects to a pipe with the plug extending through a hole in the end to screw into the pipe, to secure the bell-shaped member to the pipe by pressing a portion of the end between the plug and the pipe. The opposite end of the bell-shaped member sits against the concrete form and is secured to the form by fastening members that pass through the bell-shaped member into the concrete form. To remove the concrete form, the fastening members are cut or removed to provide access for a tool that is inserted to unscrew the plug from the pipe. Once the plug is unscrewed, the bell-shaped member is removed, leaving the volume defined by the mold to provide access to the pipe. It is believed that the mold described in FIG. 3 of EP2312088 is not an efficient design because of the labor and time required to assemble the plug and bell-shaped member on to the pipe, to engage and disengage the fastening members, and to remove the plug from the pipe. It is also believed that the design is not efficient because of the need for the plug component and the costs associated with the extra component.

A three-piece mold is described in U.S. Patent Publication No. 2010/0319196 to Rosenberg, which is incorporated by reference in its entirety. As shown in FIG. 2, a cylindrical cap having a flat plate is mounted flatly on a concrete form with screws so that a cylindrical wall extends from the flat plate to engage a sleeve that defines the displacement volume. The sleeve is connected to a pipe with a plug that holds the sleeve to the pipe, with the plug fitting in a space within the cylindrical wall of the cylindrical cap. When the concrete form is removed, the cylindrical cap is pulled out of the sleeve, leaving the sleeve accessible to a tool that removes the plug and sleeve from the volume defined by the mold within the concrete. It is believed that the mold described in Rosenberg is not an efficient design because of the labor and time required to assemble the plug and sleeve onto the pipe, and because of the need for an additional plug component and the costs associated with the extra component. It is also believed that the mold described in Rosenberg is not an efficient design because of the labor and time required to mount the cylindrical cap in a correct orientation and to remove both the plug and the sleeve. It is further believed that the Rosenberg design is not sufficiently sturdy for a construction site because the cylindrical wall can bend when stepped on or suffer damage that prevents reuse of the cylindrical cap.

In view of the above-described deficiencies associated with prior techniques, among others, there is a need for a sprinkler piping mold that can displace concrete in a manner that reduces the cost and effort required to assemble and tear down the mold, allows for simpler connection of the mold to a concrete form, provides sturdiness resistant to damage, and permits the reuse of construction materials.

SUMMARY OF THE INVENTION

The present invention provides for the installation of piping and fittings for fire protection systems positioned within concrete walls.

In one preferred embodiment, a sprinkler mold assembly as described herein places the mold against a concrete form to create a displaced volume of concrete. The mold assembly includes a cover that defines the displaced volume and has a pipe connector that directly connects to a piping system to seal the system for pressure testing, and that has an inner surface engages an insert mounted on the concrete form. More specifically, the mold assembly includes an insert which has identical opposing first and second insert ends and a cylindrical surface which is disposed between the first and second insert ends. The first and second insert ends define a plurality of fastener passages extending through the insert. The mold assembly also provides a cover, including a cover end and a cylindrical wall extending from the cover end to a cylindrical wall edge to define an interior of the cylindrical wall. The cover end has a connector extending from the cover end in a direction opposite to the cylindrical wall and having an outer surface configured to connect to and occlude the piping system. In some preferred embodiments the sprinkler mold assembly can provide an o-ring disposed on the cover about the connector. In some preferred embodiments the interior of the cylindrical wall has a plurality of supports distributed about the wall, and engaging the cover end. In some preferred embodiments a portion of the cover end facing the interior volume having a tool engagement surface configured to receive a tool inserted into the interior volume. In some preferred embodiments, the sprinkler mold assembly can provide a tool engagement surface which is a socket for engaging a hex wrench and has a plurality of supports. The tool has a plurality of tines defining spaces configured to receive the plurality of supports. In some preferred embodiments the mold assembly has a cylindrical wall having a wall thickness that increases as the cylindrical wall extends from the cover end to define a conical outer surface of the cylindrical wall and to define within the interior a non-conical inner surface of the cylindrical wall.

In another preferred embodiment, the method of preparing a mold for molding concrete is provided which includes a reversible insert that can be mounted on the concrete form in either direction, and constructed durably to withstand damage and remain suitable for reuse. The method includes providing an opening for accessing an end of a sprinkler piping system disposed in the concrete, and includes mounting a reversible insert to a concrete form. The reversible insert has identical opposing first and second insert ends and a cylindrical surface disposed between the first and second insert ends. The method includes occluding the piping system with a connector portion of a cover; and mounting the cover over the insert. In some preferred embodiments, the method further includes inserting fasteners through the first and second ends of the reversible insert. In some preferred embodiments, the method includes a cover which is a unitary structure with the connector portion. In some preferred embodiments the cover can be removed by inserting a tool into the cover to engage a tool engagement surface of the cover; a tool engagement surface which is a socket for engaging a hex wrench. In some preferred embodiments, the method provides a tool engagement surface which has a plurality of supports and a tool which has a plurality of tines defining spaces configured to receive the plurality of supports.

In still yet another preferred embodiment the removal of the cover simultaneously unplugs the piping system and uncovers the volume within the concrete that was formed by the mold. In some preferred embodiments, the method includes removing the cover with a cover removal tool which can be inserted into the cover to engage a tool engagement surface of the cover and has a plurality of supports. The cover removal tool includes a first end and a second end opposing the first end. The second end of the cover removal tool has a peripheral edge from which a plurality of tines extends away from the first end. The plurality of tines defines a space between each tine, each space configured to receive one of the plurality of supports to engage the cover.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION

The present invention addresses the above-described deficiencies of prior techniques, among others, by providing a sprinkler piping mold that minimizes components, reduces assembly and disassembly time and labor, and provides durable and re-useable components.

Figure 1:
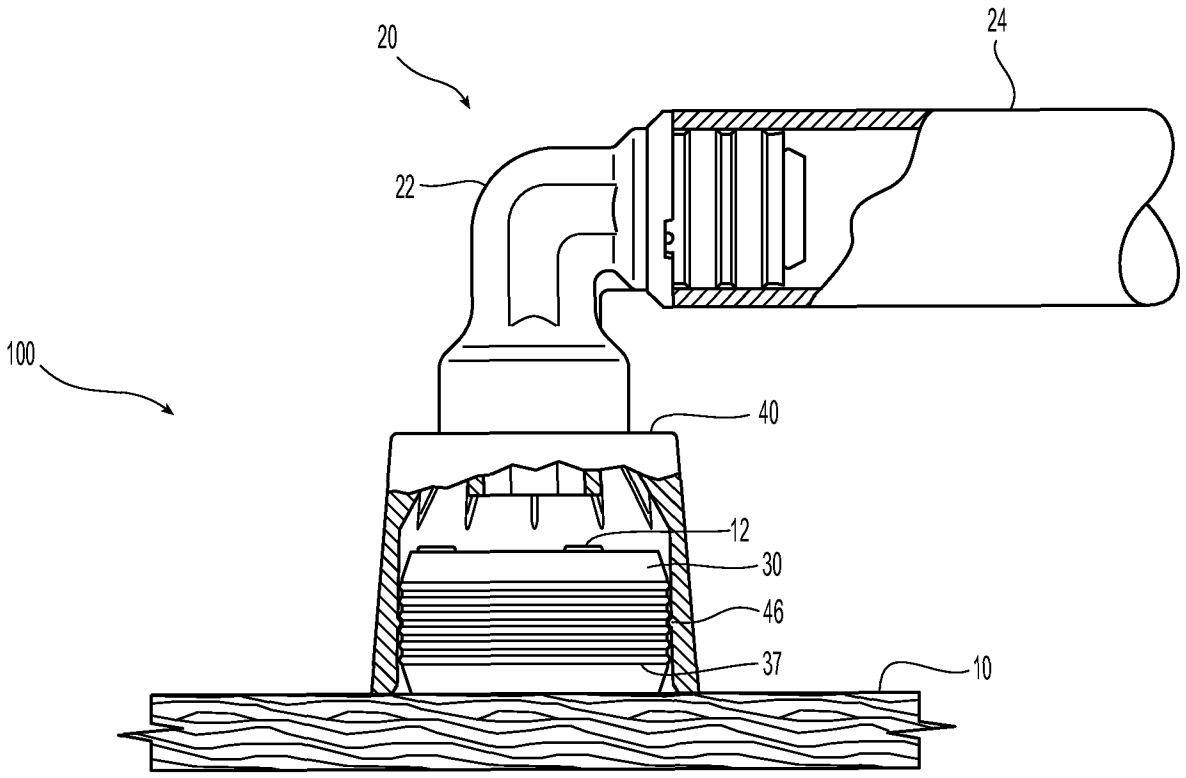
FIG. 1 is a partial cross-section view of an embodiment of a sprinkler mold assembly in accordance with an embodiment of the invention.

FIG. 1 shows a partial cross-section of an assembled sprinkler mold assembly 100 in accordance with an embodiment of the invention, mounted on a concrete form 10 and connected to a piping system 20. The mold assembly 100 can have an insert 30 connected to the concrete form 10 and a cover 40 slidably mounted over the insert 30 and connected to the piping system 20. The insert 30 can be connected to the concrete form 10 by fasteners 12 (e.g., screws or nails) extending through the insert 30 to engage the concrete form 10. Alternatively, the insert 30 can be secured to the concrete form 10 by another type of fastener that passes through the insert 30 and the concrete form 10 (e.g., a bolt), that extends from the insert 30 into the concrete form 10 (e.g., a barb or hook), or is disposed between the insert 30 and the concrete form 10 (e.g., an adhesive). The exterior of the insert 30 can have a cylindrical shape that provides a sliding engagement with the interior of the cover 40. The sliding engagement can include a series of ridges 37 that increase the friction of the sliding engagement to secure the mounted cover 40 to the insert 30, and/or includes a series of mating projections 46 (shown in more detail in FIG. 3), ridges, or grooves on the interior of the cover 40 that engage the insert 30 to increase friction between the cover 40 and insert 30. The cover 40 can include a connector 45 (shown in FIG. 3) that has threading that mates with internal threading of the piping system 20 to plug the end of the piping system 20. The piping system 20 can include a fitting 22 connected to piping 24, with a threaded end of the fitting 22 that mates with the threads of the connector 45. The piping 24 can connect to a source of fire fighting fluid (not shown).

Figures 2A, 2B, 2C:
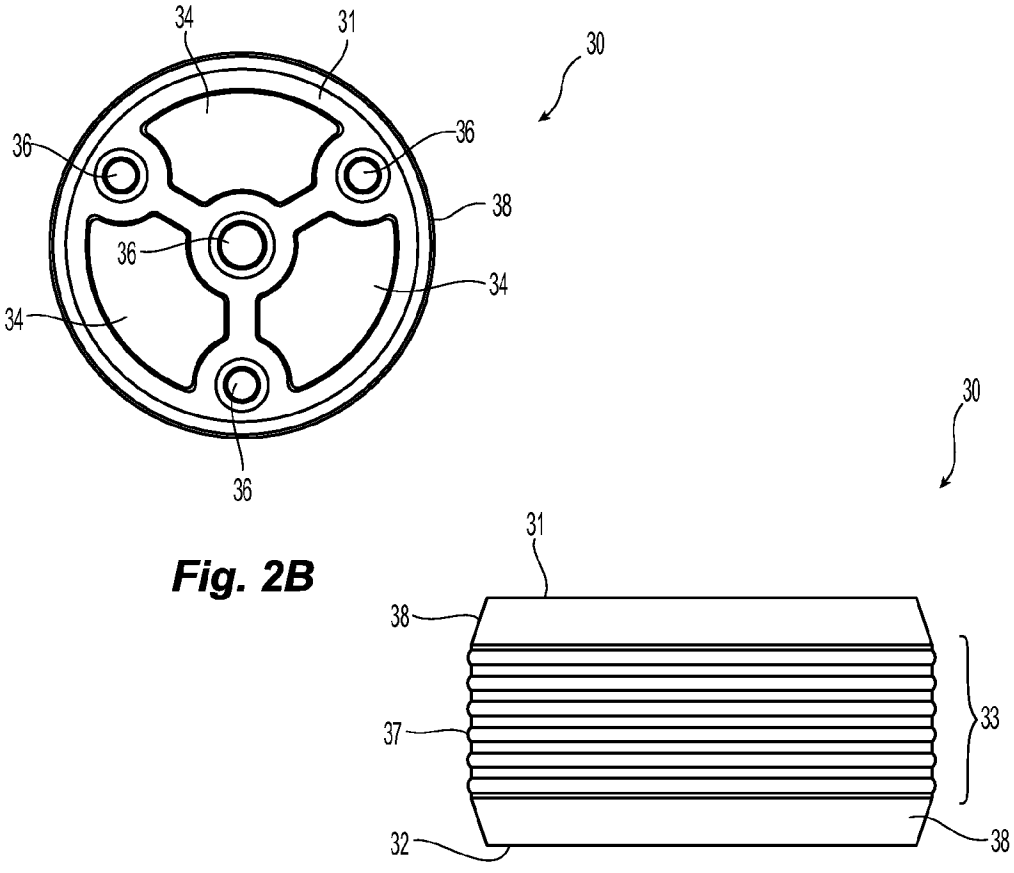
FIGS. 2A-2C are isometric, top, and side views, respectively, of an insert of the embodiment of FIG. 1.

FIG. 2A is an isometric view, FIG. 2B is a top view, and FIG. 2C is a side view of an insert 30 in accordance with an embodiment of the invention. The insert 30 can have a cylindrical shape with a first end 31 and second end 32 and a cylindrical surface 33 on the side of the insert 30 extending between the first and second ends 31, 32. The insert 30 can be identical when viewed from the first end 31 or the second end 32 (i.e., reversible), which allows the insert 30 to be connected to a concrete form 10 from either end. The insert 30 on its interior can have passages extending from the first end 31 to the second end 32 to provide channels 34 and/or fastener holes 36. The channels 34 can be provided to reduce the weight and material cost of the insert 30. The fastener holes 36 can provide access for fasteners 12 (not shown in FIG. 2) that can pass through the fastener holes 36 to connect the insert 30 to the concrete form 10, with either the first end 31 or the second end 32 disposed to press against the concrete form 10. The cylindrical surface 33 can include ridges 37 circumferentially about the insert 30 and configured to engage the interior of the cover 40. The insert 30 can also include a tapered edge 38 where the cylindrical surface 33 meets the first end 31 and second end 32.

Figure 3C:
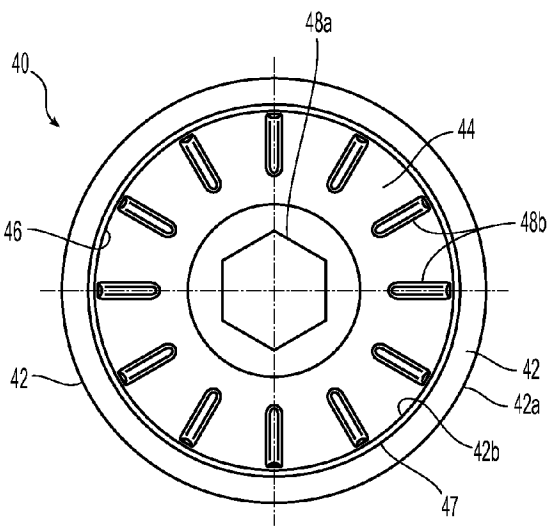
FIGS. 3A-3C are isometric, cross-sectional, and bottom views, respectively, of a cover of the embodiment of FIG. 1.
Figure 3B:
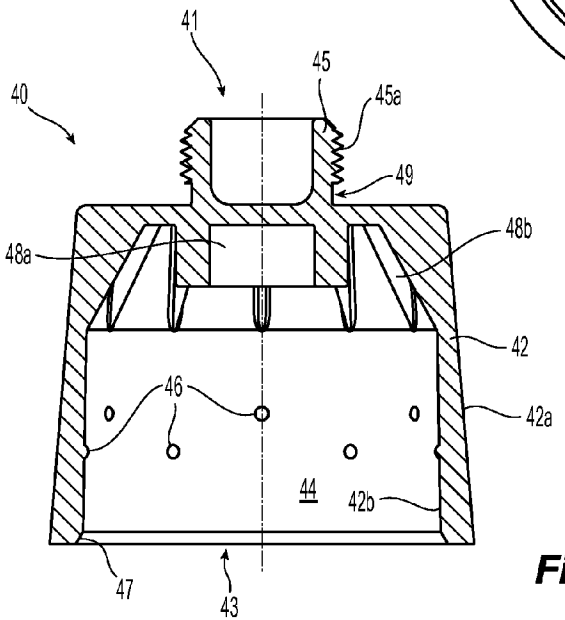
Figure 3A:
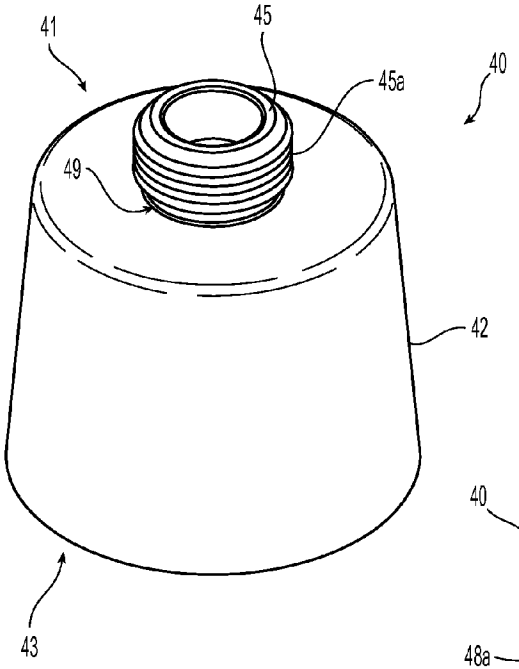

FIG. 3A is an isometric view, FIG. 3B is a cross-sectional view, and FIG. 3C is a bottom view of a cover 40 in accordance with an embodiment of the invention. The cover 40 can include a cover end 41 and a cylindrical wall 42 extending from the cover end 41 to a cylindrical wall edge that defines an open end 43 and an interior volume 44 of the cover 40 within the cylindrical wall 42. The cover end 41 can include a connector 45 providing threads 45*a* configured to engage mating threads of the fitting 22 to occlude the piping system 20. The occluding by the fitting 22 can be a complete occlusion sufficient to allow the piping system 20 to pass a pressure or leak test.

The cylindrical wall 42 can have an outer surface 42*a* and an inner surface 42*b*. The outer surface 42*a* can define a conical shape that starts at the cover end 41 at a first diameter and increases along the length of the cylindrical wall 42 until reaching a larger second diameter at the open end 43. The outer surface 42*a* can be smooth so as to facilitate the release of the cover 40 from hardened concrete. The inner surface 42*b* of the cylindrical wall 42 can have a tubular shape that does not increase or decrease in diameter. The inner surface 42*b* can include a series of projections 46 that extend into the interior volume 44 to provide addition friction when engaging the ridges 37 of the insert 30. The inner surface 42*b* can also or instead have ridges or grooves that mate with the ridges 37 of the insert 30. The inner surface 42*b* at the open end 43 can include a tapered edge 47 configured to facilitate the entry of the insert 30 into the interior volume 44 of the cover 40. The inner surface 42*b* at the cover end 41 can include a tool engagement surface 48*a,b* configured to mate with a tool 51 (such as shown in FIG. 5F) that can be used to rotate the cover 40 so as to engage or disengage the threads 45*a* from the fitting 22. The tool engagement surface 48*a,b* can include a socket 48*a* for engaging a hex wrench. The tool engagement surface 48*a,b* can also include supports 48*b* that support the cylindrical wall 42 and provide spaces between the supports 48*b* that can accept a cover removal tool 50 (FIG. 4). The supports can be triangular shaped and disposed to join the cylindrical wall 42 to the inner surface 42*b* of the cover end 41 or, alternatively, can have a different shape such as a beam extending at an angle between the cylindrical wall 42 and the inner surface 42*b* of the cover end 41. The tool 51, whether a hex wrench or a cover removal tool 50, can engage the tool engagement surface 48*a,b* so as to provide a rotational force that can rotate the cover 40 to engage or disengage the connection between connector 45 and the fitting 22. The cover 40 can also include a spacing 49 configured to accept an o-ring (not shown in FIG. 3, but shown in FIGS. 5B and 5F) that can assist in providing a seal between the cover 40 and the fitting 22.

Figure 4A:
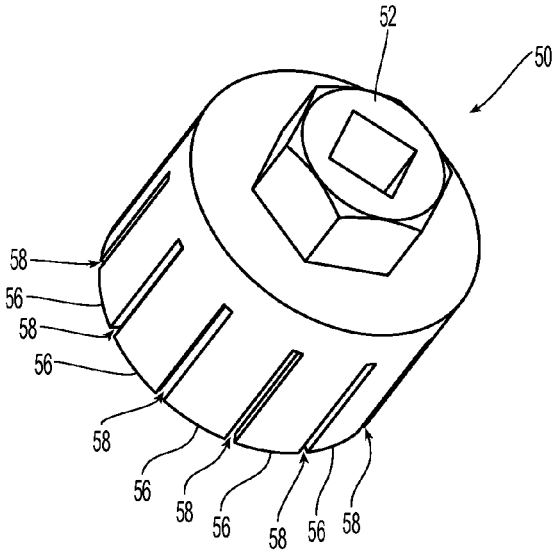
FIGS. 4A-4D are isometric, isometric, top, and side views, respectively, of a cover removal tool in accordance with an embodiment of the invention.
Figure 4B:
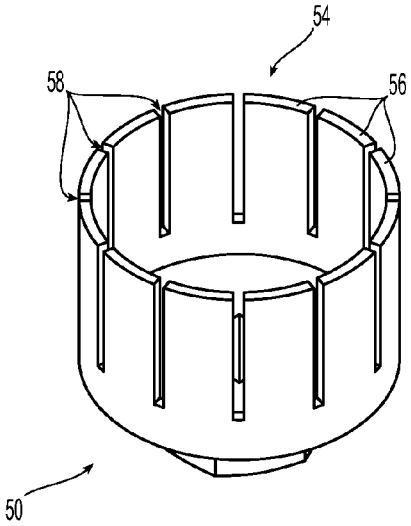
Figure 4C:
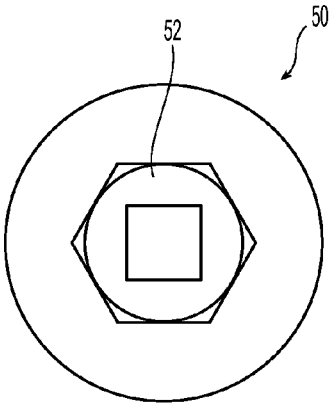
Figure 4D:
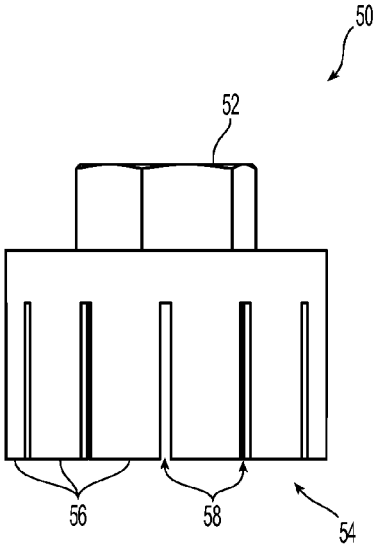

FIG. 4A shows an isometric view, FIG. 4B shows an isometric view, FIG. 4C shows a top view, and FIG. 4D shows a side view of a cover removal tool 50 in accordance with an embodiment of the invention. The cover removal tool 50 can include a socket end 52 configured to engage a wrench (not shown) and a tine end 54 having a series of tines 56 distributed circumferentially about the tine end 54 to provide spaces 58 between the tines 56. The spaces 58 can be configured to receive the supports 48*b* of the cover 40 so that the tines 56 can contact the supports 48*b*. When the cover removal tool 50 is rotated with a wrench, the rotational force can be imparted to each of supports 48*b* by each of the tines 56 to cause the cover 40 to rotate and release from the fitting 22 and release from the hardened concrete. The cover removal tool 50 can also be used in a similar fashion to rotate the cover 40 to cause the cover 40 to screw into the fitting 22.

Figure 5A:
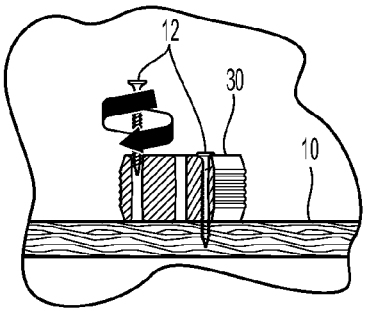
FIGS. 5A-5F are partial cross-sectional views of an installation and removal of a sprinkler mold assembly in accordance with an embodiment of the invention.
Figure 5D:
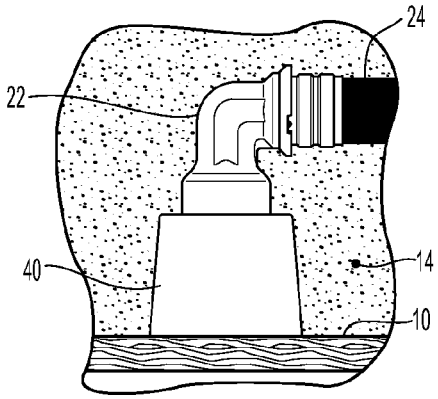
Figure 5B:
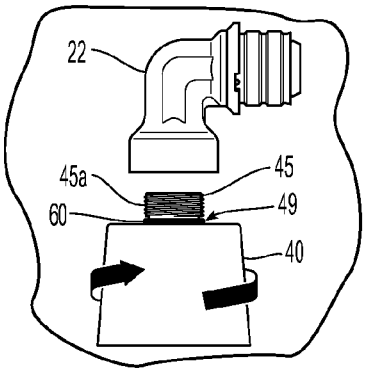
Figure 5E:
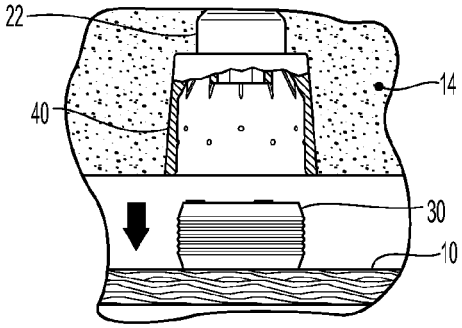
Figure 5C:
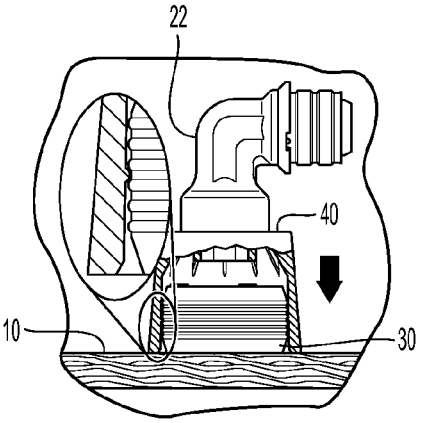
Figure 5F:
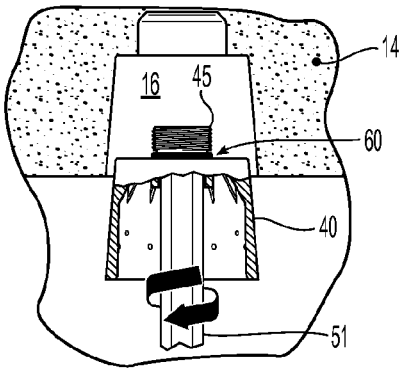

FIGS. 5A-5F show the assembly and disassembly of a sprinkler mold assembly 100 in accordance with an embodiment of the invention. As shown in FIG. 5A, the insert 30 can be mounted to the concrete form 10 with the fasteners 12. The insert 30 can be identical at each end so that the first end 31 or the second end 32 can abut the concrete form 10. As shown, the fasteners 12 can be inserted through the fastener holes 36 to reach the concrete form 10 and secure the insert 30 to the concrete form 10. As shown in FIG. 5B, the cover 40 can be positioned for connection to the fitting 22, with the connector 45 being screwed into the fitting 22 so that the threads 45*a* engage the internal threads of the fitting 22. As shown, an o-ring 60 can be placed at the spacing 49 on the cover 40 to facilitate a sealing engagement between the fitting 22 and the cover 40. As shown in FIG. 5C, the coupled fitting 22 and cover 40 can be positioned over the insert 30 so that the ridges 37 on the insert 22 engage the projections 46 on the inside of the cover 40. The cover 40 can be advanced over the insert 30 so that the open end 43 of the cover 40 abuts the concrete form 10.

As shown in FIG. 5D, the piping 24 can be connected to the fitting 22, and the concrete 14 can be introduced to the space defined by the concrete form 10 so that the concrete 14 envelopes the assembly of the piping 24, fitting 22, and the cover 40. As shown in FIG. 5E, after the concrete 14 has hardened sufficiently, the concrete form 10 can be removed from the concrete 14. The removal of the concrete form 10 takes away the insert 30 due to the attachment of the insert 30 to the concrete form 10 and due to the sliding engagement between the insert 30 and the cover 40. However, the cover 40 can remain in the concrete 14 after the concrete form 10 and insert 30 are removed because the cover 40 is connected to the fitting 22. As shown in FIG. 5F, a tool 51 can be inserted into the internal volume 44 of the cover 40 to engage the tool engagement surface 48*a,b*. As shown, the tool 51 can be a hex wrench that engages the socket 48*a* to facilitate the rotation of the cover 40 to disengage the connector 45 from the fitting 22. As can be appreciated, after the cover 40 is removed, the area of displaced concrete 16 remains and can provide access to the fitting 22 for the subsequent connection of a sprinkler (not shown).

As can be appreciated from the embodiment illustrated by sprinkler mold assembly 100, the mold assembly can require only two components (excluding the o-ring and the fasteners) to plug the piping system and removably connect the mold assembly to the concrete form, which provides a simpler configuration that can require less time and labor to assemble and disassemble as compared to existing molds that may require a plug that secures a part of the mold to the piping system. Also, as illustrated by the described embodiment, the mold assembly can use an insert that can be mounted to the concrete form in any direction that places a flat side of the insert against the form, which can simplify the assembly of the mold and save time and labor during assembly as compared to existing systems that may require the assembler to reposition components in a specific orientations. Further, as illustrated in the described embodiments, the mold assembly can used an insert that has a dense structure that can withstand abuse and maintain a shape suitable for coupling with other components of the mold assembly, as compared to existing systems that may have a wall that can be deformed or damaged and rendered unsuitable for engagement with other mold components.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

What is claimed is:

1. A mold assembly for a piping system that is to be disposed in a concrete structure, the mold assembly comprising:
   an insert, the insert having identical opposing first and second insert ends and a cylindrical surface disposed between the first and second insert ends, the first and second insert ends defining a plurality of fastener passages extending through the insert; and
   a unitary cover, the unitary cover having a cover end and a cylindrical wall extending from the cover end to a cylindrical wall edge to define an interior volume of the cylindrical wall, the cover end having a connector extending from the cover end in a direction opposite to the cylindrical wall, the connector having an outer surface configured to connect to and occlude the piping system, the interior volume of the cylindrical wall having a plurality of supports distributed about the cylindrical wall, the plurality of supports supporting the cylindrical wall and engaging the cover end, a portion of the cover end facing the interior volume having a tool engagement surface configured to receive a tool inserted into the interior volume.

2. The mold assembly of claim 1, further comprising an o-ring disposed on the unitary cover about the connector.

3. The mold assembly of claim 1, wherein the tool engagement surface is a socket for engaging a hex wrench.

4. The mold assembly of claim 1, wherein the tool engagement surface includes the plurality of supports, and wherein the tool has a plurality of tines defining spaces configured to receive the plurality of supports.

5. The mold assembly of claim 1, wherein the cylindrical wall has a wall thickness that increases as the cylindrical wall extends from the cover end to define a conical outer surface of the cylindrical wall and to define within the interior volume a non-conical inner surface of the cylindrical wall.

6. The mold assembly of claim 1, wherein the first and second insert ends further define a plurality of channels extending through the insert and disposed between the plurality of fastener passages.

7. The mold assembly of claim 1, wherein the plurality of fastener passages include a central passage that runs through a center of space circumscribed by the cylindrical surface and a plurality of peripheral passages disposed around the central passage.

8. The mold assembly of claim 7, wherein the first and second insert ends further define a plurality of channels extending through the insert and the plurality of channels are disposed between the central and peripheral passages.

9. A method of preparing a mold for molding concrete to provide an opening for accessing an end of a sprinkler piping system disposed in the concrete, the method comprising:
   mounting a reversible insert to a concrete form, the reversible insert having identical opposing first and second insert ends and a cylindrical surface disposed between the first and second insert ends;
   occluding the piping system with a connector portion of a unitary cover, the unitary cover having a cover end and a cylindrical wall extending from the cover end to a cylindrical wall edge to define an interior volume of the cylindrical wall, the interior volume of the cylindrical wall having a plurality of supports distributed about the cylindrical wall, the plurality of supports supporting the cylindrical wall and engaging the cover end;
   mounting the unitary cover over the insert; and
   removing the unitary cover from the piping system with a tool that engages a tool engagement surface of the unitary cover.

10. The method of claim 9, wherein the mounting of the reversible insert to the concrete form comprises inserting fasteners through the first and second ends of the reversible insert.

11. The method of claim 9, wherein the tool engagement surface is a socket for engaging a hex wrench.

12. The method of claim 9, wherein the tool engagement surface includes the plurality of supports, and wherein the tool has a plurality of tines defining spaces configured to receive the plurality of supports.

13. The method of claim 9, wherein the tool comprises:
   a first end; and
   a second end opposing the first end, the second end having a peripheral edge from which a plurality of tines extend away from the first end, the plurality of tines defining a space between each tine, each space configured to receive one of the plurality of supports to engage the unitary cover.

14. The method of claim 10, wherein the first and second insert ends define a plurality of channels extending through the insert and disposed between a plurality of fastener passages through which each of the corresponding fasteners is inserted.

15. The method of claim 10, wherein the inserting of the fasteners through the first and second ends of the reversible insert comprises inserting the fasteners through a plurality of corresponding fastener passages that include a central passage that runs through a center of space circumscribed by the cylindrical surface and a plurality of peripheral passages disposed around the central passage.

16. The method of claim 15, wherein the first and second insert ends define a plurality of channels extending through the insert and the plurality of channels are disposed between the central and peripheral passages.

17. A method of preparing a mold for molding concrete to provide an opening for accessing an end of a sprinkler piping system disposed in the concrete, the method comprising:

mounting a reversible insert to a concrete form, the reversible insert having identical opposing first and second insert ends and a cylindrical surface disposed between the first and second insert ends;

occluding the piping system with a connector portion of a cover;

mounting the cover over the insert; and inserting a tool into the cover to engage a tool engagement surface of the cover to remove the cover, wherein the tool engagement surface has a plurality of supports, and wherein the tool has a plurality of tines defining spaces configured to receive the plurality of supports.

18. A method of preparing a mold for molding concrete to provide an opening for accessing an end of a sprinkler piping system disposed in the concrete, the method comprising:

mounting a reversible insert to a concrete form, the reversible insert having identical opposing first and second insert ends and a cylindrical surface disposed between the first and second insert ends;

occluding the piping system with a connector portion of a cover;

mounting the cover over the insert; and inserting a cover removal tool into the cover to engage a tool engagement surface of the cover to remove the cover, the cover having a plurality of supports, the cover removal tool comprising:

a first end; and a second end opposing the first end, the second end having a peripheral edge from which a plurality of tines extend away from the first end, the plurality of tines defining a space between each tine, each space configured to receive one of the plurality of supports to engage the cover.

19. A mold assembly for a piping system within a concrete structure, the mold assembly comprising:

an insert, the insert having identical opposing first and second insert ends and a cylindrical surface disposed along a central axis between the first and second insert ends, the first and second insert ends defining a plurality of fastener passages extending through the insert, one of the plurality of fastener passages being disposed along the central axis; and a unitary cover, the unitary cover having a cover end and a cylindrical wall extending from the cover end to a cylindrical wall edge to define an interior volume of the cylindrical wall, the cylindrical wall having a wall thickness that increases as the cylindrical wall extends from the cover end to define a conical outer surface of the cylindrical wall and to define within the interior a non-conical inner surface of the cylindrical wall, the cover end having a connector extending from the cover end in a direction opposite to the cylindrical wall, the connector having an outer surface configured to connect to and occlude the piping system, and a portion of the cover end facing the interior volume has a tool engagement surface that receives a tool inserted into the interior volume.

20. The mold assembly of claim 19, wherein the interior of the cylindrical wall has a plurality of supports distributed about the wall, the plurality of supports engaging the cover end.

21. The mold assembly of claim 19, wherein the tool engagement surface is a socket for engaging a hex wrench.

22. The mold assembly of claim 20, wherein the tool engagement surface has a plurality of supports, and wherein the tool has a plurality of tines defining spaces configured to receive the plurality of supports.

23. The mold assembly of claim 19, wherein the cylindrical surface includes ridges that engage the non-conical inner surface of the cylindrical wall.

* * * * *